US006830488B2

(12) United States Patent
Bush et al.

(10) Patent No.: US 6,830,488 B2
(45) Date of Patent: Dec. 14, 2004

(54) MODULAR JACK WITH WIRE MANAGEMENT

(75) Inventors: Wavell Bush, Centennial, CO (US); Damon DeBenedictis, Centennial, CO (US)

(73) Assignee: Krone, Inc., Centennial, CO (US)

( * ) Notice: Subject to any disclaimer, the term of this patent is extended or adjusted under 35 U.S.C. 154(b) by 0 days.

(21) Appl. No.: 10/435,940

(22) Filed: May 12, 2003

(65) Prior Publication Data

US 2004/0229517 A1 Nov. 18, 2004

(51) Int. Cl.[7] ..... H01R 24/00
(52) U.S. Cl. ..... 439/676; 439/719
(58) Field of Search ..... 439/676, 719, 439/404, 407, 417, 457, 456, 459, 465, 468

(56) References Cited

U.S. PATENT DOCUMENTS 5,924,896 A 7/1999 Arnett et al.
5,947,772 A 9/1999 Arnett et al.
5,975,919 A 11/1999 Arnett et al.
6,093,048 A 7/2000 Arnett et al.
6,193,526 B1 * 2/2001 Milner et al. ..... 439/676
6,238,231 B1 * 5/2001 Chapman et al. ..... 439/404
6,334,792 B1 * 1/2002 Schmidt et al. ..... 439/676
6,361,354 B1 3/2002 Viklund et al.
6,488,525 B2 12/2002 Abel et al.
2003/0157842 A1 * 8/2003 Arnett et al. ..... 439/676

OTHER PUBLICATIONS

From http://www.siemon.com/literature/product–spec-sheets/pdf/MAX 6 Modules.pdf.
From http://www.siemon.com/white_papers/99–07–01–anatomy. asp.

* cited by examiner

*Primary Examiner*—P. Austin Bradley
*Assistant Examiner*—Felix O. Figueroa
(74) *Attorney, Agent, or Firm*—Merchant & Gould PC

(57) ABSTRACT

A modular jack, comprising a jack frame and terminal housing, for accepting one or more twisted pairs of conductors. Running through a base of the terminal housing are one or more wire management tunnels. Each of the tunnels has a first opening located within a first end of the terminal housing, a second opening located within a second end of the terminal housing, and a third opening located within a surface of the terminal housing from which extends a plurality of turrets. A twisted pair of conductors enters the wire management tunnel through either the first or second opening, and then travels through the wire management tunnel before exiting through said third opening. The twisted pair of conductors exiting the third opening then terminate within one or more slots defined by neighboring turrets.

26 Claims, 10 Drawing Sheets

MODULAR JACK WITH WIRE MANAGEMENT

FIELD OF THE INVENTION

The present invention relates generally to the field of telecommunication networks, and more specifically, to a new modular jack to which a plurality of twisted-pairs of conductors are to be connected.

BACKGROUND OF THE INVENTION

The use of various devices to connect one or more signal-carrying cables or conductors to one another has steadily increased over the years due to the ever increasing use of data networks in everyday life. The use of insulation displacement connectors (IDCs) has undergone especially rapid growth due to the ease with which they allow conductors to connect to various interface devices such as jacks and connection blocks.

However, as data networks continue to expand in size and complexity, so does the need for connection devices, such as IDC jacks, that offer greater ease in the installation and management of a plurality of conductors or wires that run to and from a connection point. Furthermore, as the industry's standards in networking and communications continue to develop, the need for connectors that offer a consistent high level of performance continues to grow. For example, a significant amount of signal noise or crosstalk can develop within a standard jack connection because of something as simple as wire placement. Accordingly, there has been increased demand for an IDC jack that better addresses the issues of ease of installation, along with wire or conductor placement.

SUMMARY OF THE INVENTION

The present invention relates to a modular jack for connecting one or more twisted pairs of conductors. Included within the module is a jack frame and a terminal housing. Running through a base of the terminal housing is one or more wire management tunnels, with each tunnel possessing a first opening located within a first end of the terminal housing, a second opening located within a second end of the terminal housing, and a third opening located within a surface of the terminal housing from which extend a plurality of turrets

DESCRIPTION OF THE PREFERRED EMBODIMENT

Figure 1:
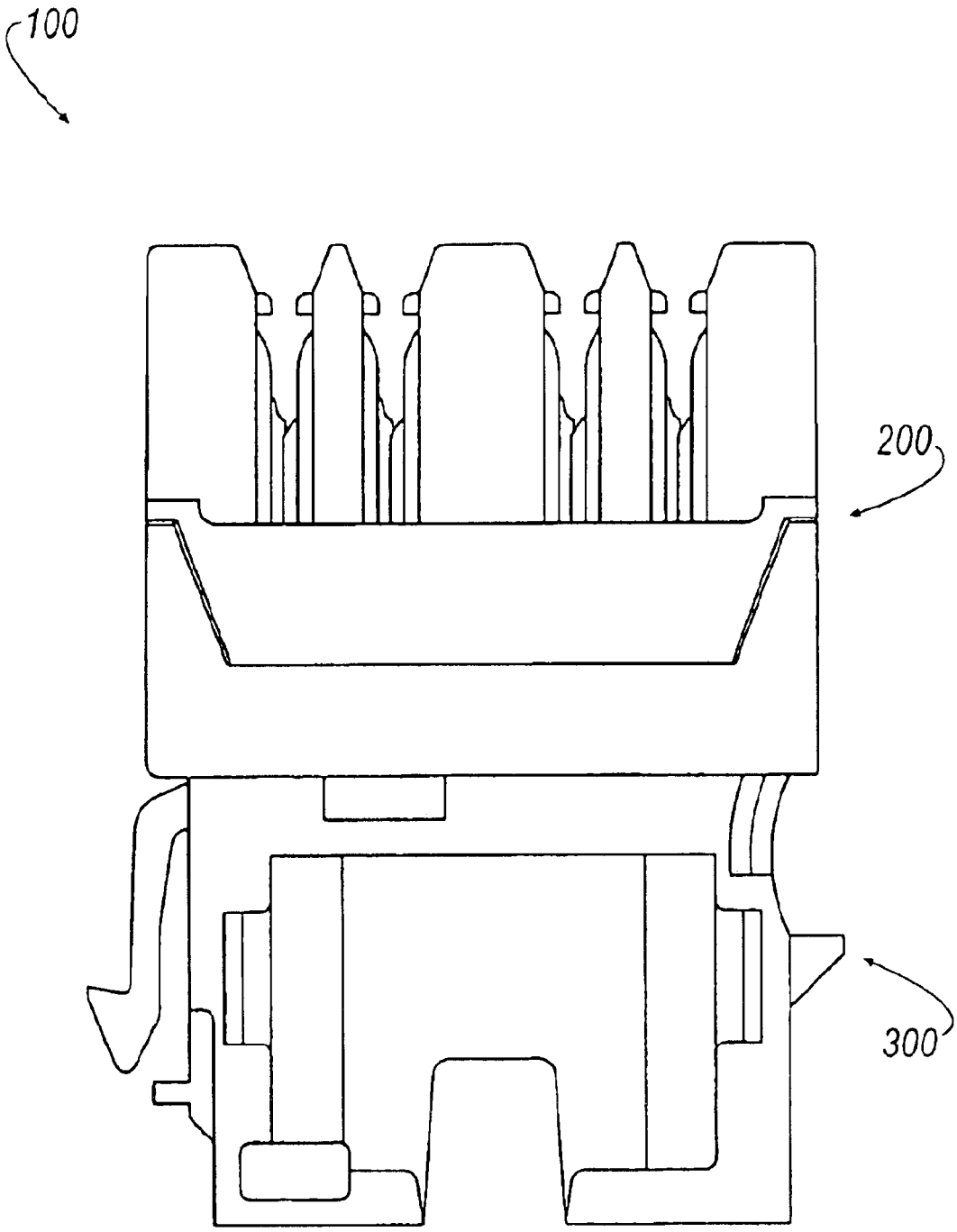
FIG. 1 illustrates a modular jack according to one embodiment of the present invention.

One preferred embodiment of the invention will now be discussed in reference to FIG. 1. illustrated in FIG. 1 is a modular jack 100, such as, for example, a RJ-45 jack, for electrically connecting to a cable containing one or more twisted-pairs of conductors. Comprising modular jack 100 is a terminal housing 200, to which one or more twisted-pairs of conductors are terminated, and a jack frame 300 that attaches to the back side of the terminal housing 200 and is designed to receive and electrically connect to a corresponding plug.

Figure 2:
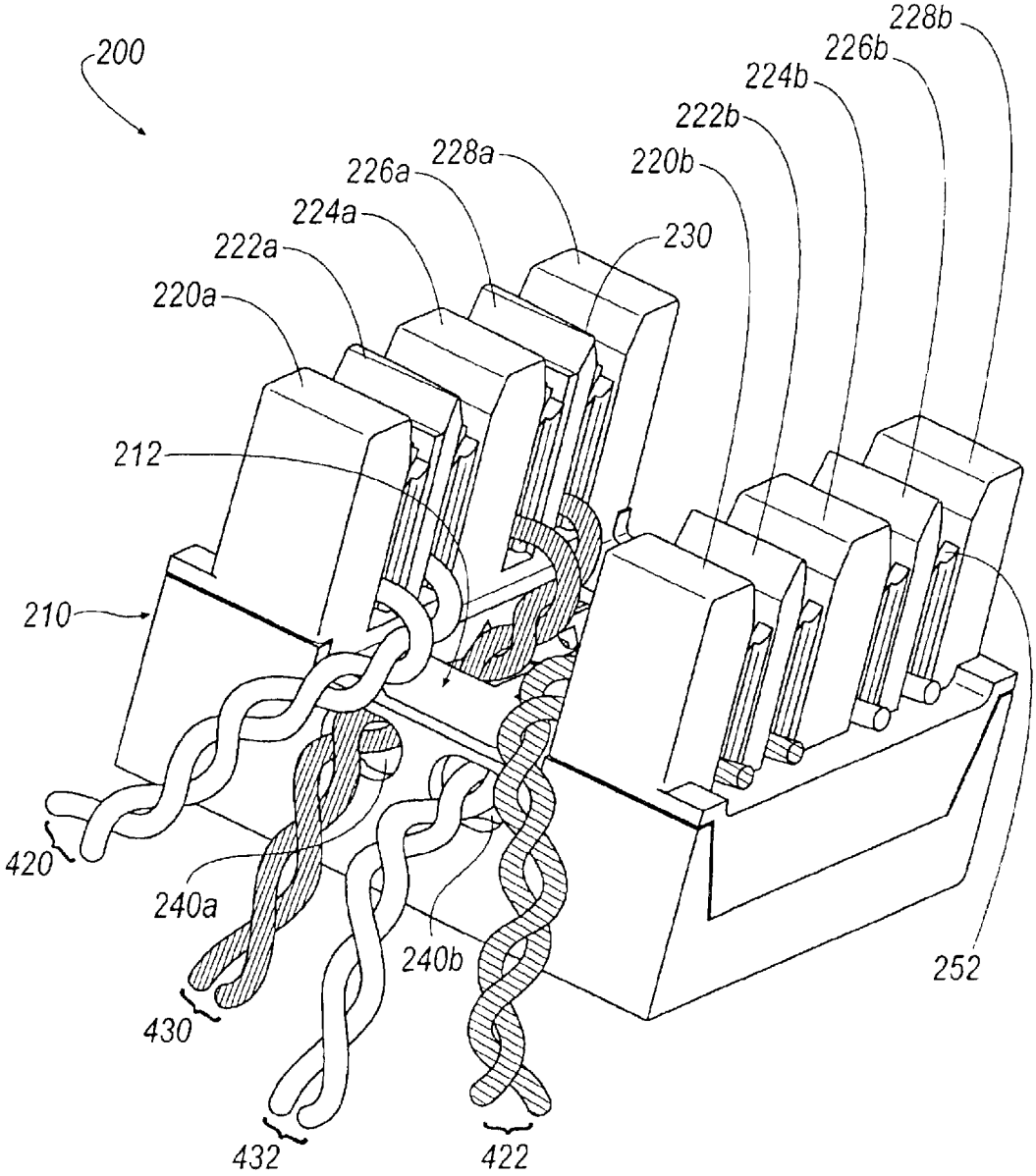
FIG. 2 illustrates a perspective view of the terminal housing of a modular jack according to one embodiment.

As illustrated in FIG. 2, the terminal housing 200 is generally comprised of a base 210 from which projects outward a plurality of turrets 220–228 that align into one or more rows. According to the present embodiment illustrated in FIG. 2, the turrets 220–228 actually make up two distinct rows 220*a*–228*a* and 220*b*–228*b*.

In the present embodiment, every other turret, i.e. 222 and 226, possesses a beveled edge 230 at the top of the turret 220–228, which projects outward from the base 210 of the terminal housing 200. The beveled edge 230 is created by two converging chamfers that come together at an acute angle. Preferably the two chamfers are symmetrical to one another, resulting in the beveled edge 230 being equally distant from each side of the turret.

As further illustrated in the embodiment of FIG. 2, each of the turrets 220–228 is generally structured to have first and second sides that define slots neighboring the turrets 220–228. Those turrets 220–228 not possessing beveled edges 230 have a generally planar top surface.

In the preferred embodiment illustrated in FIG. 2, all of the turrets 220–228, regardless of whether they possess a beveled edge, are of essentially the same height. However, according to an alternative embodiment, the turrets possessing a beveled edge could be shorter or longer than the turrets not possessing a beveled edge 230 in order to facilitate manipulation of conductors around the turrets.

In general, one or more twisted pairs of conductors 420–432 are brought into the interior of the terminal housing 200. Each twisted pair 420–432 is subsequently split into its individual conductors. Each individual conductor is subsequently terminated within one of the slots defined by and running between two adjacent turrets 220–228. Each slot running between two adjacent turrets 220–228 contains an insulation displacement connection (IDC) (not illustrated in the Figures) that pierces the insulation around the individual conductor and creates an electrical connection between the conductor and the terminal housing 200. These insulation displacement connectors may be of any type, including both those IDC devices that require a punch-down tool to secure a conductor, as well as those IDC devices designed to securely hold a conductor without the use of a punch-down tool. One example, provided for illustrative purposes, includes a current standard in the art such as a Krone® 45 degree insulation displacement connector. To assure that each individual conductor is held firmly in place within a slot, one or more ribs 252 extend outward from each of the turrets 220–228 and into a slot, thereby enhancing the holding force applied by the turrets 220–228 upon the individual conductors.

Figure 3:
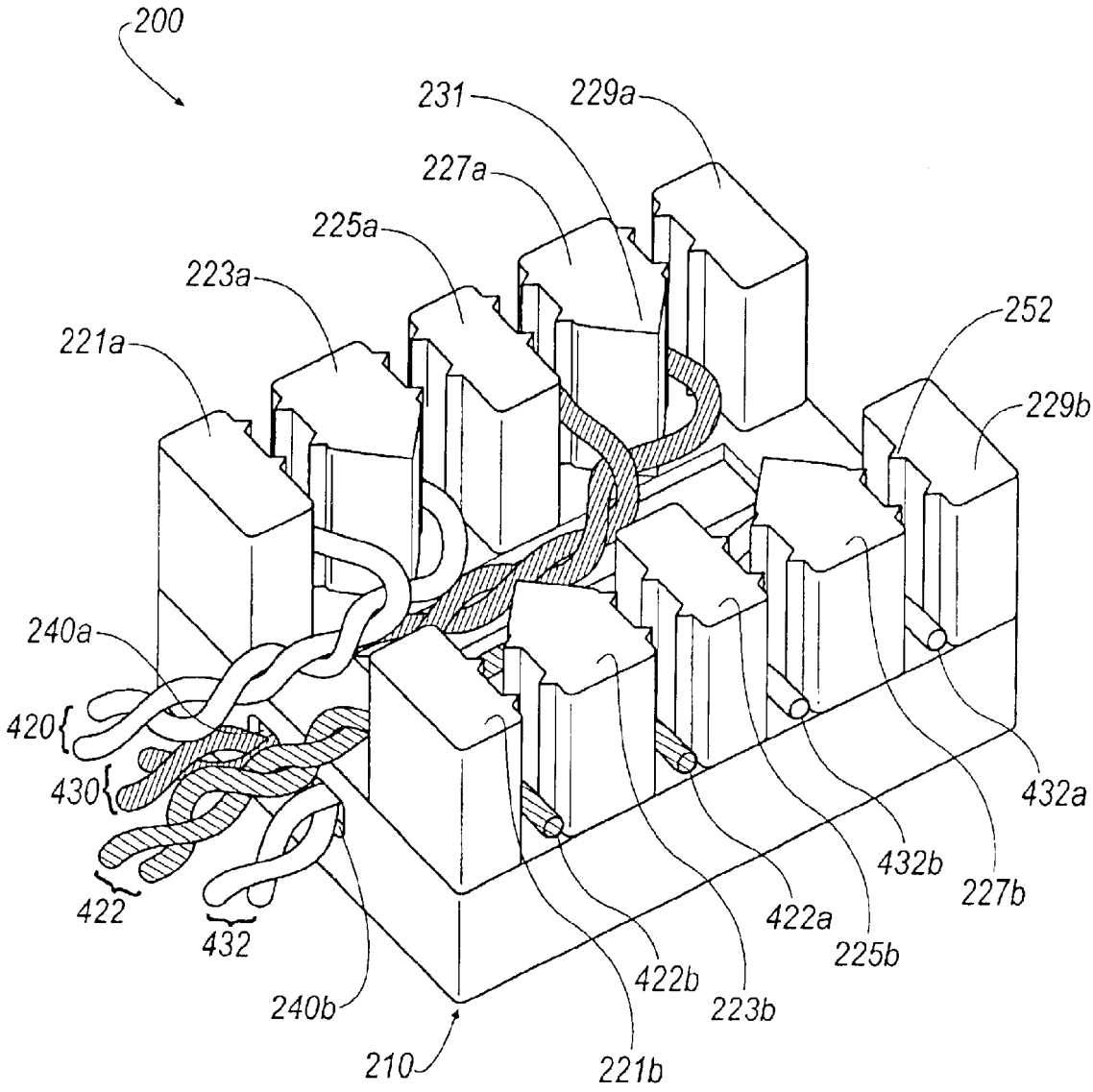
FIG. 3 illustrates a perspective view of the terminal housing of a modular jack according to an alternative embodiment showing turrets with beveled edges having a greater thickness than the other turrets.

According to an alternative embodiment, as illustrated in FIG. 3, every other turret, i.e. 223 and 227, possesses a beveled edge 231 that faces toward the interior of the terminal housing 200. As in the previous embodiment, the beveled edge 231 is created by two converging chamfers that come together at an acute angle. Preferably the two chamfers are symmetrical to one another, resulting in the beveled edge 231 being equally distant from each side of the turret.

According to this alternative embodiment illustrated in FIG. 3, the beveled edge 231 runs for the entire height of the turret. Alternatively, the turrets could be shaped so that the bevel edge 231 runs for only a portion of the height of the turret, such as, for example, the upper-half of the turrets.

As further illustrated in the embodiment of FIG. 3, each of the turrets according to this alternative embodiment is generally structured to have a generally planar top surface. Furthermore, those turrets not possessing a beveled edge have generally planar inner and outer surfaces that run parallel to one another, while those turrets with beveled edges have a generally planar outer surface that lies opposite to the beveled edge.

Similar to the previous embodiment, one or more ribs 252 extend outward from each of the turrets 221–229 of the current embodiment and into a neighboring slot. This assures that each individual conductor is held firmly in place within a slot by enhancing the holding force applied by the turrets 221–229 upon the individual conductors.

According to the embodiment illustrated in FIG. 3, the turrets 221–229, regardless of whether they possess a beveled edge, are of essentially the same height. However, as similarly emphasized in the previous embodiment, the height of all the turrets 221–229 need not be equal. Instead, turret height could be manipulated so that the turrets possessing a beveled edge are either shorter or longer in height than the turrets not possessing a beveled edge, To assist in bringing one or more of the twisted pairs of conductors 420–432 into the interior of the terminal housing 200, wire management tunnels 240*a* and 240*b* are provided that run within the base 210 for the length of the terminal housing 200. Openings within each end of the terminal housing then provide access to the wire management tunnels 240*a* and 240*b*.

Figure 4:
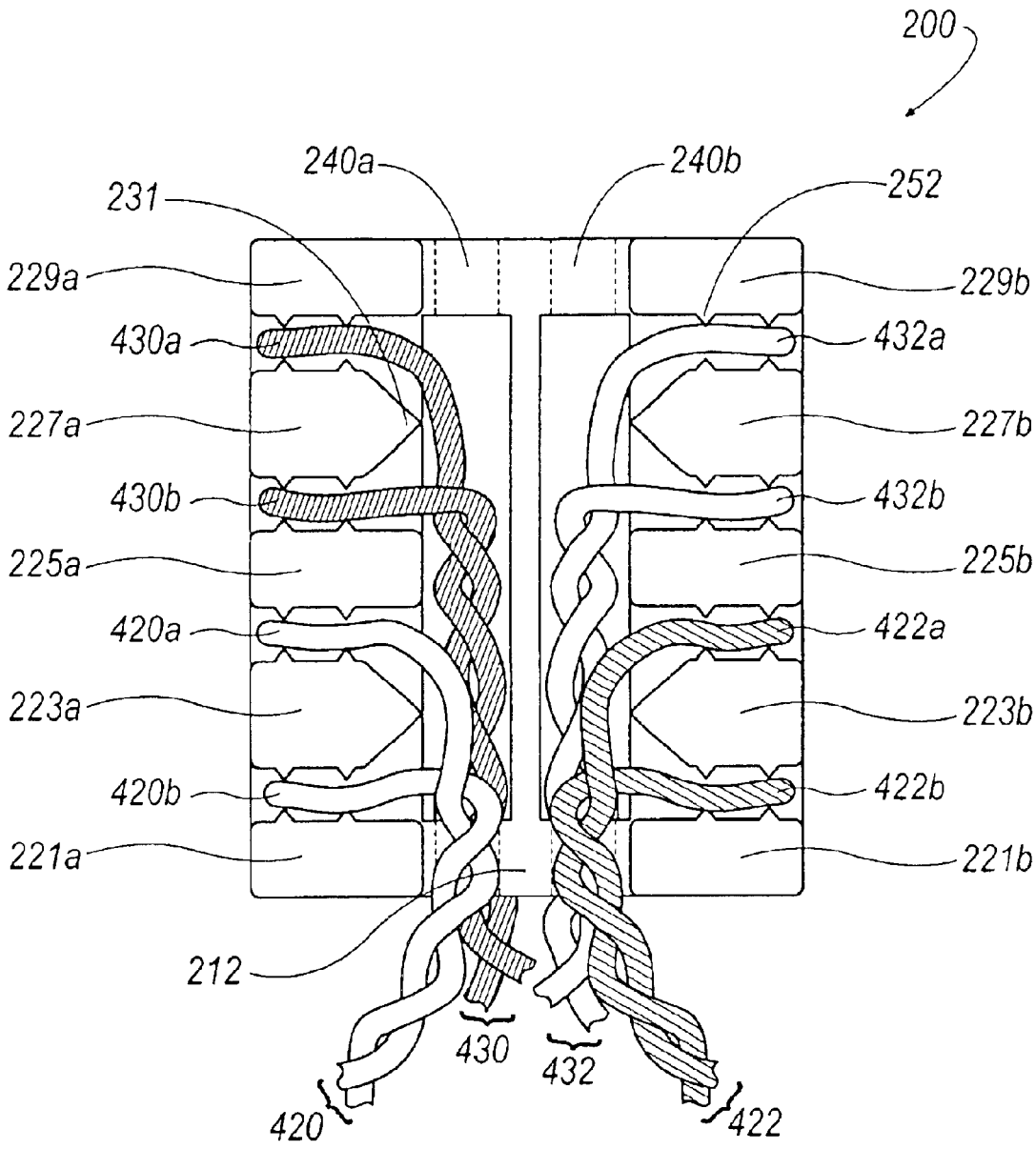
FIG. 4 illustrates a top-down view of the terminal housing depicted in FIG. 3.

Specifically, as illustrated in FIGS. 2–4, the wire management tunnels 240*a* and 240*b* pass through an end wall 212 and then continue on through the base 210 of the terminal housing 200. Openings provided within the top surface of terminal housing 200 then provide access to these tunnels 240*a* and 240*b* from the interior of the terminal housing 200.

As illustrated in FIGS. 2–4, a twisted pair of conductors, such as, for example, twisted pair 430 or 432, is passed through one of these wire management tunnels 240*a* and 240*b*, thereby providing the twisted pair access to the interior of the terminal housing 200. Alternatively, a twisted pair of conductors, such as, for example, twisted pair 420 or 422, can access the interior of the terminal housing 200 by simply running the twisted pair 420 or 422 over the top of wire management tunnel 240*a* or 240*b*, thereby directly entering into the interior of the terminal housing 200 without having to go through one of the wire management tunnels 240*a* or 240*b*.

Upon being brought into the terminal housing 200, each of the twisted pairs of conductors 420–432 is separated into its individual conductors and subsequently terminated within either a nearby or distant one of the IDC slots of the terminal housing 200. The twisted pairs of conductors, i.e. twisted pairs 430 and 432, whose individual conductors are to be terminated within one of the distant slots are run through one of the wire management tunnels 240*a* and 240*b*. Conversely, those twisted pairs of conductors, i.e., 420 and 422, whose individual conductors are to terminate within a nearby slot are brought directly into the interior of terminal housing 200 by running the twisted pair over the wire management tunnels 240*a* and 240*b*. Accordingly, those twisted pairs of conductors (i.e., 430 and 432) that enter the terminal housing 200 through one of the wire management tunnels 240*a* and 240*b* are subsequently terminated at the slots located farthest from the side where the conductors entered the terminal housing 200, while those twisted pairs of conductors (i.e., 420 and 422) that directly enter into the interior of terminal housing 200 are terminated within the slots that are located nearest the side where the conductors entered the terminal housing 200.

Each of the twisted pairs of conductors must be separated, or "untwisted", into their individual conductors before they can be terminated within one of the IDC slots of terminal housing 200. To initiate this separation process, the installer or technician merely has to push one of the twisted pair of conductors against the beveled edge of the appropriate turret that corresponds to the slots where termination of the individual conductors is to take place. According to the embodiment illustrated in FIG. 2, this would entail bringing the twisted pair of conductors down upon one of the turrets, i.e., turret 222 or 226, which is tipped with a beveled edge 230, while in the embodiment illustrated in FIG. 3, the twisted pair of conductors would be pushed up against the interior-facing beveled edge 231 of the appropriate turret, i.e., turret 223 or 227. The individual conductors can then be terminated within their respective IDC slots that reside on either side of the turret that was used to aid in separation of the individual conductors.

According to the embodiments illustrated in FIGS. 2–4, the turrets not possessing a beveled edge, i.e., turrets 220, 224 and 228 of FIG. 2, or alternatively, turrets 221, 225 and 229 of FIG. 3, are greater in thickness than those turrets possessing a beveled edge, i.e., turrets 222 and 226 of FIG. 2 or turrets 223 and 227 of FIG. 3. This provides greater separation between each of the twisted pairs of conductors, further reducing the chances of reduced performance due to electromagnetic interference or cross-talk between conductors However, based on the specific application in which the present invention is utilized, the widths of the two types of turrets can be adjusted to balance the desire for a smaller jack or module with the desire for a specific level of performance and the general need to minimize cross-talk between the pairs of conductors.

Figure 5A:
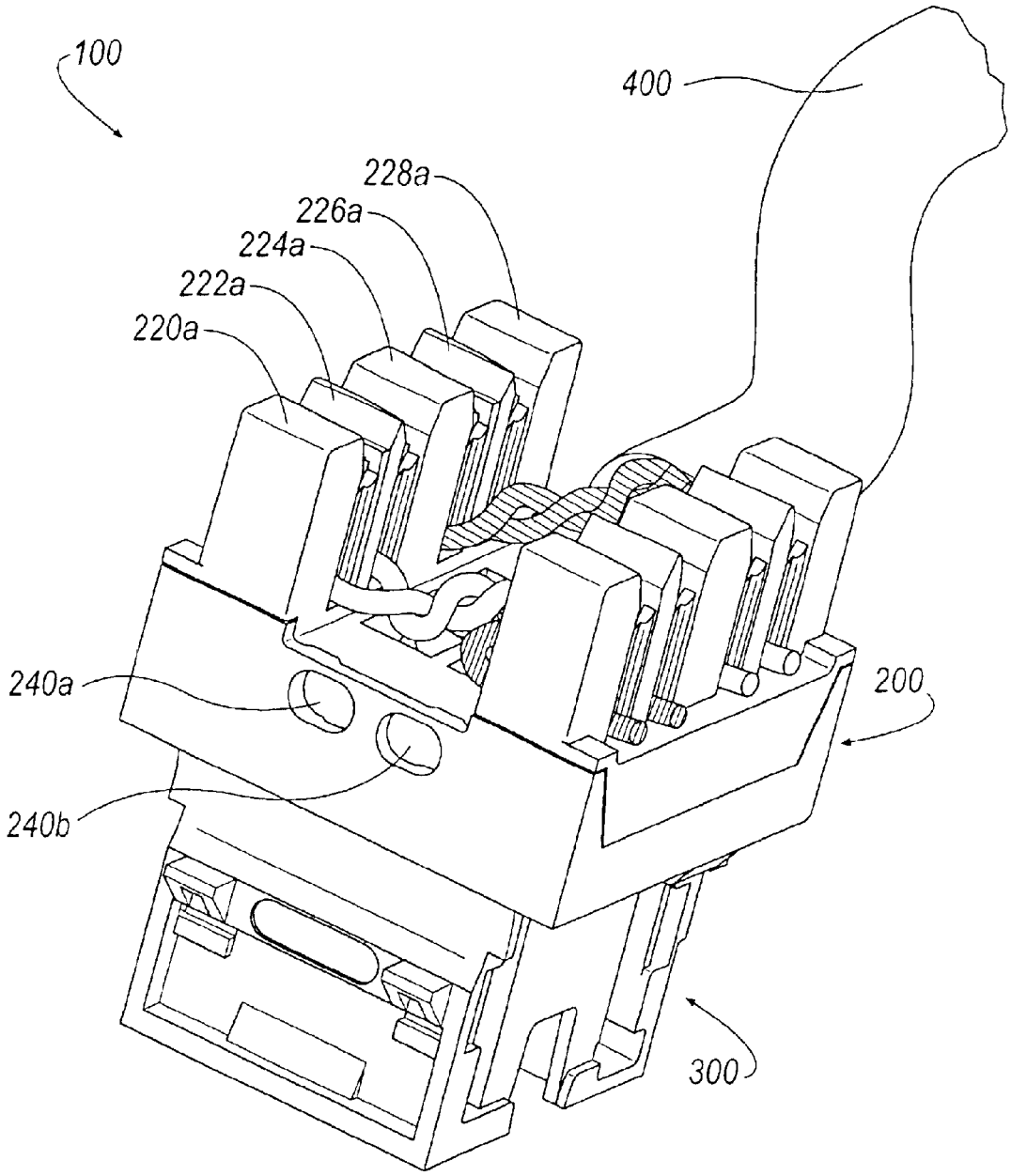
FIGS. 5*a*, 5*b* and 5*c* illustrate, respectively, the three directions from which a cable can approach and connect to the terminal housing of the modular jack.
Figure 5B:
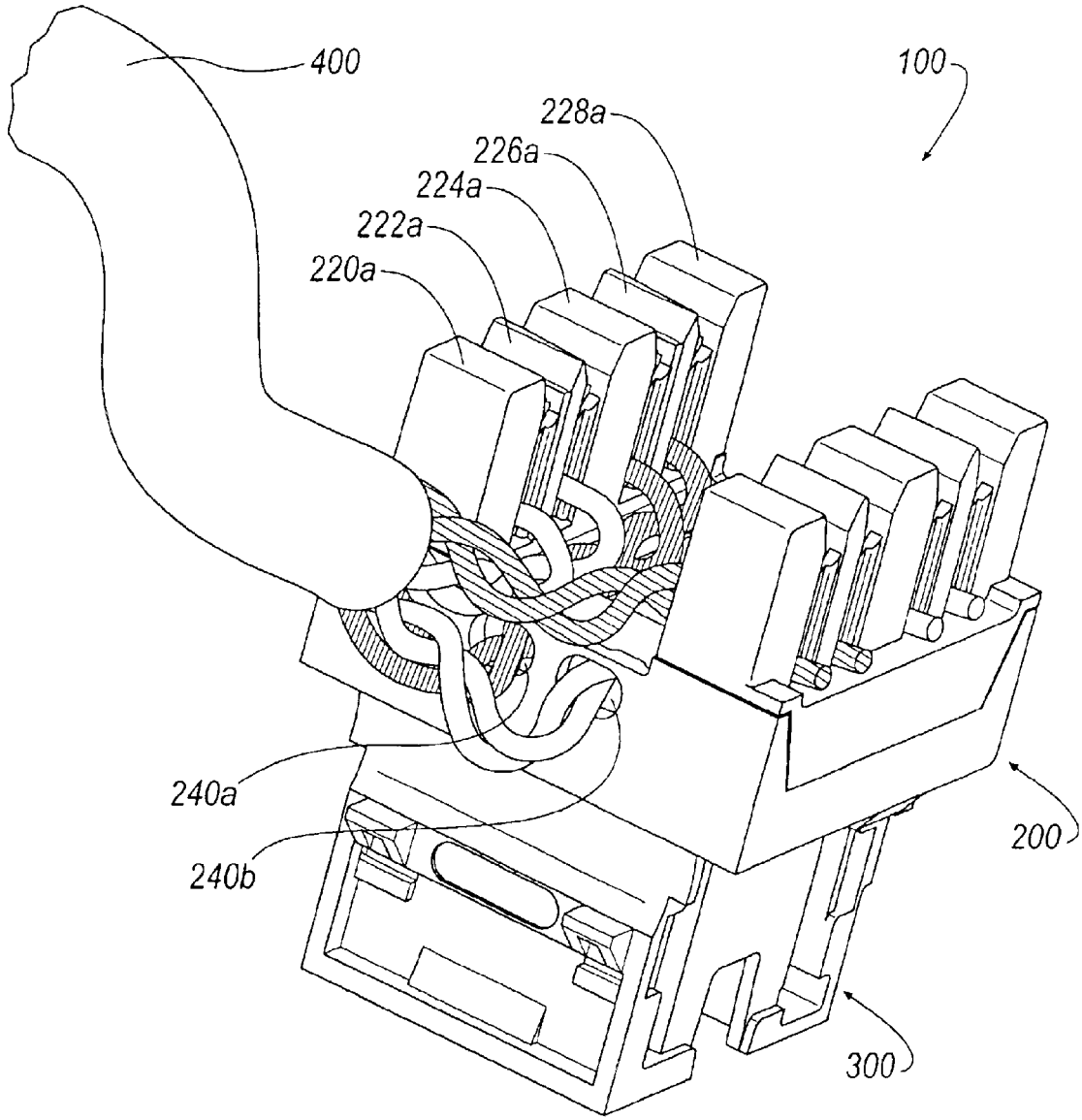
Figure 5C:
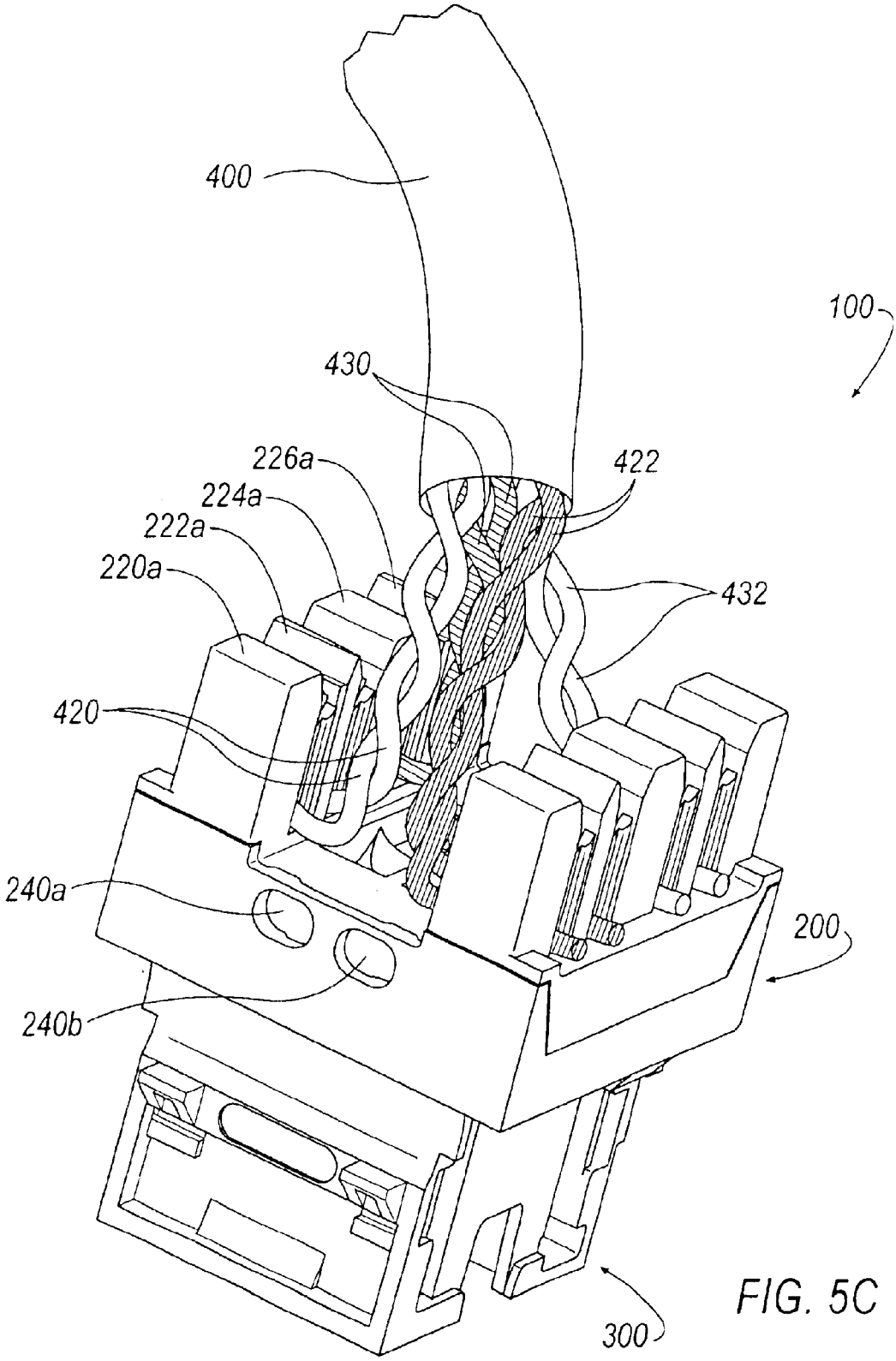
Figure 6A:
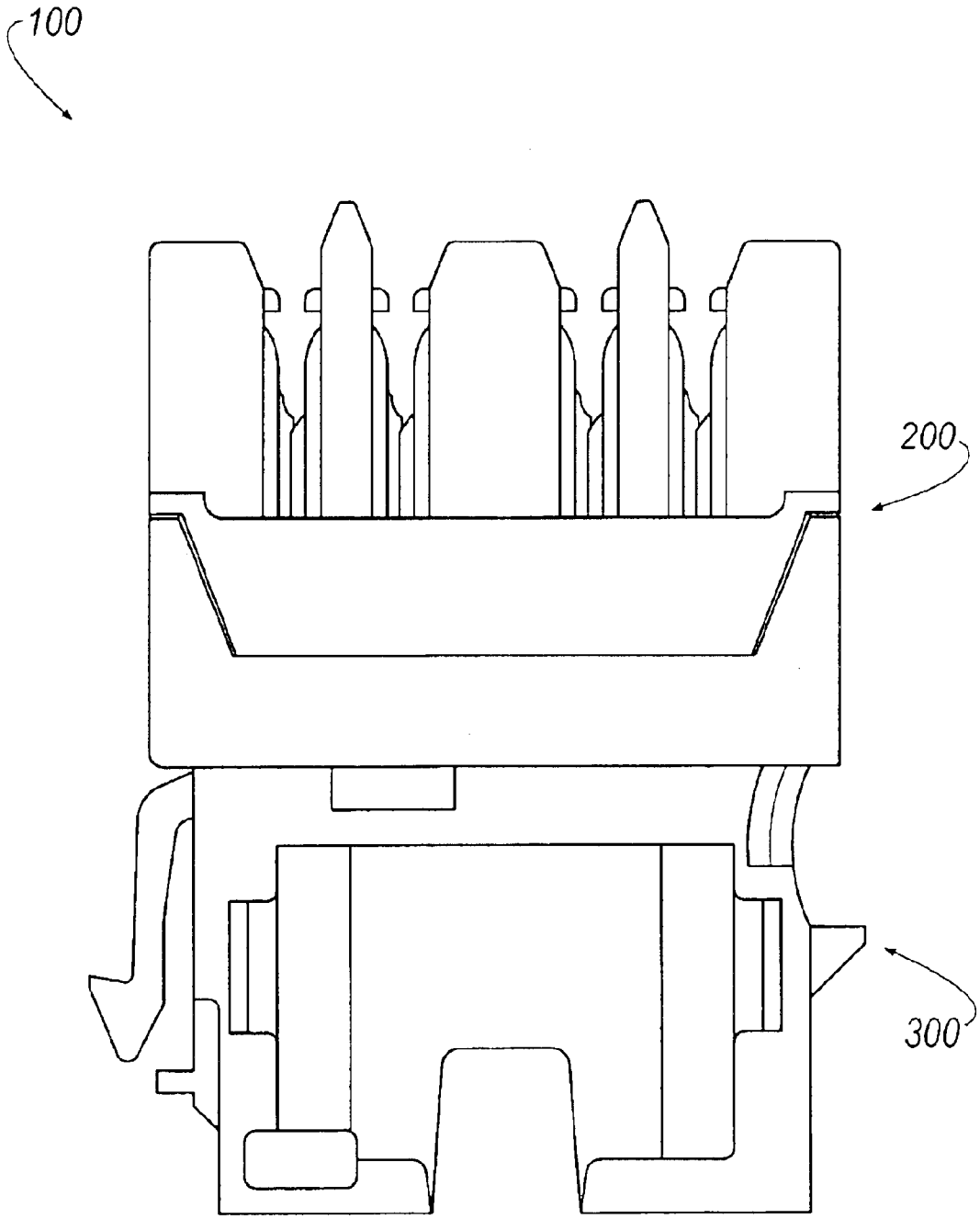
FIG. 6*a* illustrates a side view of the terminal housing according to an alternative embodiment showing the turrets with beveled edges having a height greater than the other turrets.
Figure 6B:
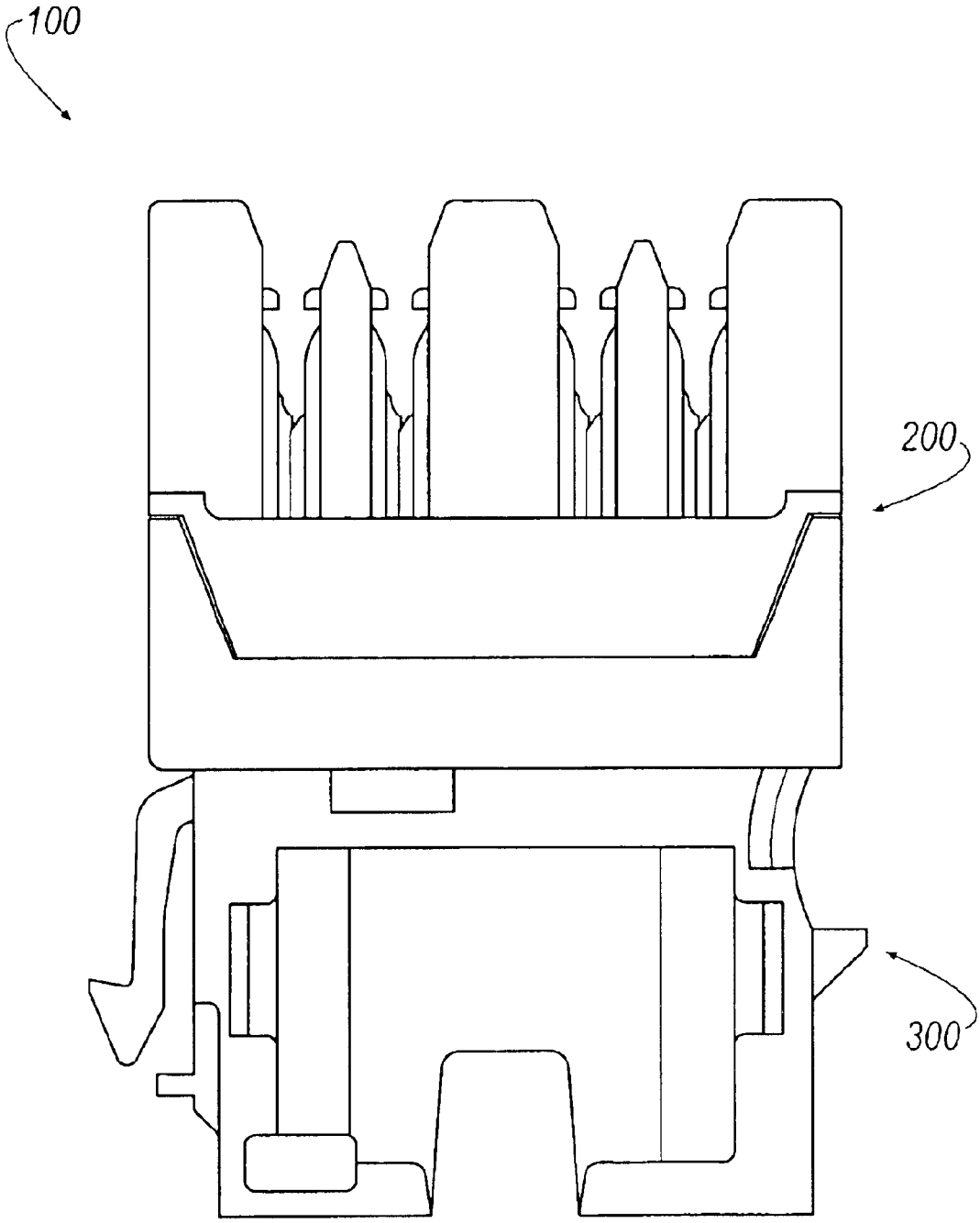
FIG. 6*b* illustrates a side view of the terminal housing according to an alternative embodiment showing the other turrets having a height greater than the turrets with beveled edges.
Figure 7:
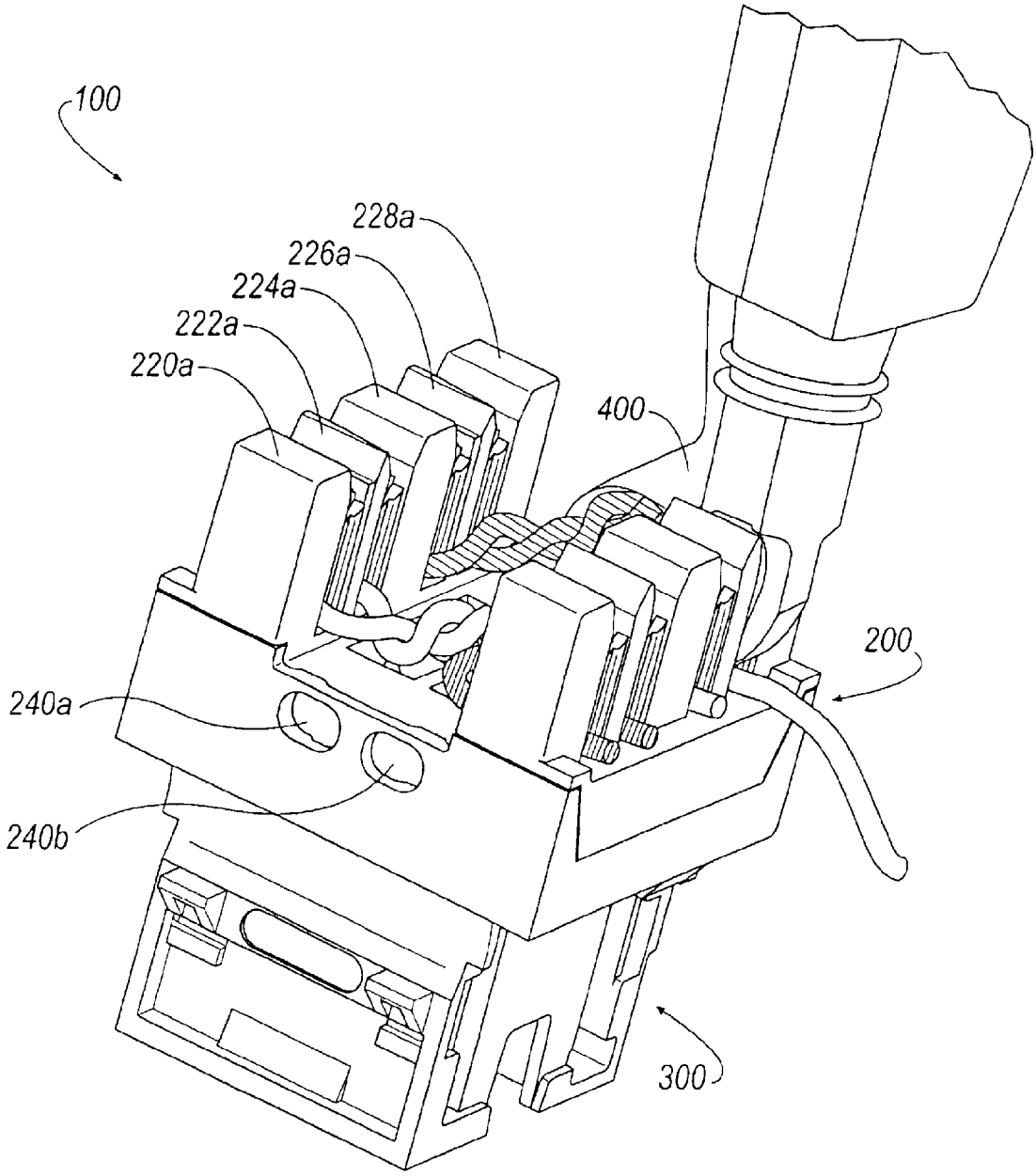
FIG. 7 illustrates a perspective view of the terminal housing of a modular jack according to one embodiment and the use of a punch-down tool.

FIGS. 5A–5C illustrate a fully assembled modular jack 100, which, as already discussed, is comprised of the terminal housing 200 and the jack frame 300. As depicted in the Figures, the terminal housing 200 and jack frame 300 attach to one another so that jack frame 300 extends out from the underside of the terminal housing 200. When attached to the terminal housing 200, jack frame 200 is able to electrically communicate with the insulation displacement connectors (IDC) (not shown) that reside in each of the slots lying between two neighboring turrets. In this manner, an electrical connection can be readily established with each of the twisted pair of conductors 420–432 by simply inserting an appropriately shaped plug into the plug receptacle 310 of the jack frame 300.

As demonstrated by the modular jack 100 depicted in FIGS. 5A–5C, the unique configuration of the present invention allows for a cable 400, containing the four twisted pair of conductors 420, 422, 430 and 432, to connect to the terminal housing 200 after approaching the terminal housing 200 from one of several different directions. See FIGS. 5A and 5B, which illustrate the same modular jack 100 from the same perspective. Cable 400 can be wired to terminal housing 200 by either approaching one end of the terminal housing 200 from a first direction, as illustrated in FIG. 5A, or by approaching the opposite end of the terminal housing 200 from a second direction opposite to that of the first direction, as illustrated in FIG. 5B. Accordingly, cable 400 is able to connect to terminal housing 200 regardless of which end of the terminal housing 200 the cable 400 is directed towards. Furthermore, as openings for the wire management tunnels 240*a* and 240*b* are provided in both ends of the terminal housing 200, cable 400 is able to preferably connect to terminal housing 200 through use of the wire management tunnels 240*a* and 240*b*, regardless of whether the cable approaches the terminal housing 200 from either the first or second opposing directions.

As an alternative to connecting to either end of terminal housing 200, cable 400 can also directly connect to terminal housing 200 without utilizing the wire management tunnels 240*a* and 240*b*. In this manner, as illustrated in FIG. 5C, cable 400 approaches the rear of modular jack 100 so that the twisted pairs of conductors 420–432 are brought directly from above the turrets into the interior of the terminal housing 200, where they can be separated into their individual conductors and terminated within the appropriate insulation displacement connectors (not shown) residing.

Accordingly, cable 400 is able to connect to either end of terminal housing 200, as illustrated in FIGS. 5A and 5B, thereby utilizing the wire management tunnels 240*a* and 240*b*, or alternatively, connect directly, thereby bypassing the wire management tunnels 240*a* and 240*b*, as illustrated in FIG. 5C. Connections that utilize the wire management tunnels 240*a* and 240*b* are generally preferable as use of the wire management system preserves the proper placement of the assorted twisted pair of conductors. This allows for a greater degree of separation to be maintained between the various twisted pair of conductors, which in turn reduces the amount of interference or cross-talk generated amongst the conductors. Specifically, by running the twisted pair of conductors that are to be terminated within distant slots, i.e., conductor pairs 430 and 432, through wire management tunnels 240*a* and 240*b*, respectively, conductor pairs 430 and 432 are physically isolated from one another, as well as being isolated from conductor pairs 420 and 422 which run outside of the wire management tunnels. This minimizes the chances of one conductor pair inducing interference upon another conductor pair. On the other hand, some installation scenarios require the flexibility of by-passing tunnels 240*a* or 240*b* either in whole or part as illustrated in FIG. 5C.

While the invention has been specifically described in connection with certain specific embodiments thereof, it is to be understood that this is by way of illustration and not of limitation, and the scope of the appended claims should be construed as broadly as the prior art will permit.

What is claimed is:

1. A modular jack, comprising:

(1) a jack frame adapted to receive a plug; and (2) a terminal housing for receiving and terminating one or more conductors, said terminal housing attached to said jack frame and comprising:

(a) a plurality of turrets extending out from a surface of said terminal housing and away from said jack frame, said plurality of turrets aligned into one or more rows;

(b) a plurality of slots defined by said plurality of turrets such that one of said plurality of slots runs in-between two neighboring turrets, each of said plurality of slots adapted to receive an insulation displacement connector (IDC) for electrically connecting to and terminating a conductor; and (c) at least one wire management tunnel running through a base of said terminal housing and associated with one of said one or more rows of said turrets, said wire management tunnel having a first opening located within a first end of said terminal housing, a second opening located within a second end of said terminal housing, and a third opening located within the surface of the terminal housing from which said plurality of turrets extend, wherein one or more conductors selectively connects to said jack by entering one of said first or second openings for said wire management tunnel, travel through said wire management tunnel and exits through said third opening onto said surface of said jack, whereupon said one or more conductors can terminate within said IDC of one or more of said plurality of slots.

2. The modular jack according to claim 1, wherein one or more conductors can bypass said wire management tunnel and connect directly to said modular jack.

3. The modular jack according to claim 1, wherein certain turrets of said plurality of turrets possess a beveled edge along a top of said turrets, said beveled edge created by two chamfers converging at an acute angle and functioning as a wedge that separates a twisted pair of conductors into individual conductors and directs each of the individual conductors to pass into one of said plurality of slots.

4. The modular jack according to claim 1, wherein certain turrets of said plurality of turrets possess a beveled edge that faces an interior of said housing and which is created by two chamfers converging at an acute angle, said beveled edge functioning as a wedge that separates a twisted pair of conductors into individual conductors and directs each of the individual conductors to pass into one of said plurality of slots.

5. The modular jack according to either claim 3 or 4, wherein each of said plurality of turrets possessing a beveled edge are neighbored on each side by one of said plurality of turrets not possessing a beveled edge.

6. The modular jack according to claim 1, wherein said plurality of slots are adapted to receive one or more conductors that are forced down into the insulation displacement connector of each of said plurality of slots by means of a punch down tool.

7. The modular jack according to claim 1, wherein the one or more conductors passed through said wire management tunnel is isolated from any other conductors not passed through said wire management tunnels.

8. The modular jack according to claim 1, wherein at least two wire management tunnels run through a base of said terminal housing, with each of said at least two wire management tunnels associated with one of said rows of said turrets.

9. A module for accepting one or more twisted-pairs of conductors, comprising:

a plurality of turrets extending out from a base of said module and aligned into at least one row; and a plurality of slots defined by said plurality of turrets such that one of said plurality of slots runs in-between two neighboring turrets of said plurality of turrets, each one of said plurality of slots adapted to receive an insulation displacement connector for electrically connecting to a conductor, wherein certain turrets of said plurality of turrets possess a beveled edge that faces an interior of said module and which is created by two chamfers converging at an angle, said beveled edge functioning as a wedge that separates the twisted pair of conductors into individual conductors and directs each of the individual conductors to pass into one of said plurality of slots.

10. The module according to claim 9, wherein said plurality of turrets are aligned into two separate rows.

11. The module according to claim 9, wherein said two chamfers are symmetrical to one another.

12. The module according to claim 9, wherein said turrets possessing a beveled edge are generally equal in height to said turrets not possessing a beveled edge.

13. The module according to claim 9, wherein said turrets possessing a beveled edge are greater in height than said turrets not possessing a beveled edge.

14. The module according to claim 9, wherein said turrets possessing a beveled edge are shorter in height than said turrets not possessing a beveled edge.

15. The module according to claim 9, wherein said beveled edge runs for an entire height of said turret.

16. The module according to claim 9, wherein each of said plurality of turrets possessing a beveled edge are neighbored on each side by one of said plurality of turrets not possessing a beveled edge.

17. The module according to claim 9, wherein each of said plurality of turrets is of generally equal thickness.

18. The module according to claim 9, wherein each of said plurality of turrets not possessing a beveled edge is greater in thickness than each of said plurality of turrets possessing a beveled edge.

19. The module according to claim 9, wherein each of said plurality of turrets possessing a beveled edge is greater in thickness than each of said plurality of turrets not possessing a beveled edge.

20. The module according to claim 9, wherein each of said plurality of turrets not possessing a beveled edge includes a substantially planar outer surface, a substantially planar inner surface parallel to said outer surface, and a substantially planar top surface.

21. The module according to claim 9, wherein each of said plurality of turrets possessing a beveled edge includes a substantially planar outer surface opposite to said beveled edge, and a substantially planar top surface.

22. The module according to claim 9, wherein each of said plurality of turrets has at least one projection that extends out from a side of said turrets into a neighboring slot, said projection for clamping in place a conductor running through said slot.

23. The module according to claim 9, further comprising at least one wire management tunnel for passage of the one or more twisted pair of conductors, said at least one wire management tunnel having a first opening within a first end of said module and a second opening located within a second end of said module opposite to said first end.

24. The module according to claim 23, wherein said at least one wire management tunnel comprises first and second wire management tunnels that run next to, but are individually distinct from, one another.

25. The module according to claim 23, wherein a first twisted pair of conductors is passed through said at least one wire management tunnel before being directed to a pair of said plurality of slots that lie furthest from the side of said module, while a second twisted-pair of conductors is passed over said at least one wire management tunnel before being directed to a pair of said plurality of slots that lie nearby said side of said module.

26. The module according to claim 1, wherein said module accepts four twisted pairs of conductors.

* * * * *

UNITED STATES PATENT AND TRADEMARK OFFICE

CERTIFICATE OF CORRECTION

PATENT NO. : 6,830,488 B2
DATED : December 14, 2004
INVENTOR(S) : Bush et al.

It is certified that error appears in the above-identified patent and that said Letters Patent is hereby corrected as shown below:

Column 8,
Line 35, "claim 1," should read -- claim 9, --.

Signed and Sealed this

Sixth Day of September, 2005

JON W. DUDAS
*Director of the United States Patent and Trademark Office*